US007184693B2

(12) United States Patent
Choi et al.

(10) Patent No.: US 7,184,693 B2
(45) Date of Patent: Feb. 27, 2007

(54) TONER CARTRIDGE USED WITH ELECTROPHOTOGRAPHIC IMAGE FORMING APPARATUS

(75) Inventors: Sam-seok Choi, Suwon-si (KR); Myoung-su Baek, Suwon-si (KR); Dong-hoon Park, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 10/915,400

(22) Filed: Aug. 11, 2004

(65) Prior Publication Data

US 2005/0084299 A1 Apr. 21, 2005

(30) Foreign Application Priority Data

Oct. 20, 2003 (KR) ..... 10-2003-0072986

(51) Int. Cl.
*G03G 15/08* (2006.01)

(52) U.S. Cl. ..... 399/281; 222/DIG. 1; 399/262

(58) Field of Classification Search ..... 399/252, 399/254, 256, 262, 265, 279, 281; 222/DIG. 1
See application file for complete search history.

(56) References Cited

U.S. PATENT DOCUMENTS 5,510,883 A * 4/1996 Kimura et al. ..... 399/256
6,907,215 B2 * 6/2005 Yasukawa et al. ..... 399/281

FOREIGN PATENT DOCUMENTS

| | | |
|---|---|---|
| JP | 11-282235 | 10/1999 |
| JP | 2001-255727 | 9/2001 |
| KR | 19423 A | 4/2000 |
| KR | 19994 A | 4/2000 |

* cited by examiner

*Primary Examiner*—Hoan Tran
(74) *Attorney, Agent, or Firm*—Stanzione & Kim, LLP

(57) ABSTRACT

A toner cartridge used with an electrophotographic image forming apparatus includes a developing roller to develop an electrostatic latent image formed on an outer circumferential surface of a photosensitive drum, a toner to supply roller supplying toner onto the developing roller, a guide member installed under the toner supplying roller to guide the toner to attach onto the surface of the toner supplying roller by a predetermined thickness, a hopper to store the toner supplied to the toner supplying roller, and an agitator rotatably installed on the hopper. A rotary shaft of the agitator is disposed in a position higher than an upper portion of the guide member.

6 Claims, 4 Drawing Sheets

TONER CARTRIDGE USED WITH ELECTROPHOTOGRAPHIC IMAGE FORMING APPARATUS

CROSS-REFERENCE TO RELATED APPLICATIONS

This application claims priority under 35 U.S.C. §119(a) from Korean Patent Application No. 2003-72986, filed on Oct 20, 2003, in the Korean Intellectual Property Office, the disclosure of which is incorporated herein in its entirety by reference.

BACKGROUND OF THE INVENTION

1. Field of the Invention

The present general inventive concept relates to a toner cartridge used with an electrophotographic image forming apparatus.

2. Description of the Related Art

An electrophotographic image forming apparatus, such as a dry type color laser printer, is an apparatus that forms an electrostatic latent image on a photosensitive substance, develops the image using powder toner, and transfers the developed image on a sheet of paper through a predetermined transferring medium to form the transferred image on the paper. The image forming apparatus includes a toner cartridge as a developing unit, which is disposed to access the photosensitive substance and contains dry toner, to develop the electrostatic latent image of the photosensitive substance.

Japanese Laid-open Patent Publication No. 2001-255727 discloses a developing apparatus including a developing roller, and a toner cartridge that supplies toner to the developing apparatus. The toner cartridge is vertically disposed to supply the toner to a toner chamber in the developing apparatus. Thus, a printer including the above developing apparatus has a large vertical volume.

In a dry type color printer having a compact structure, a toner cartridge is formed in a horizontal direction as a developing unit, thus requiring a structure, in which toner cartridges of a plurality of colors are vertically stacked.

SUMMARY OF THE INVENTION

In order to solve the foregoing and/or other problems, it is an aspect of the present general inventive concept to provide a toner cartridge that supplies toner in a horizontal direction.

The foregoing and/or other aspects of the present general inventive concept may be achieved by providing a toner cartridge used with an electrophotographic image forming apparatus, the toner cartridge including a to develop roller developing an electrostatic latent image formed on an outer circumferential surface of a photosensitive drum, a toner to supply roller supplying toner onto the developing roller, a guide member that is installed under the toner supplying roller and guides the toner to be attached onto the surface of the toner supplying roller as a predetermined thickness, a hopper to store the toner supplied to the toner supplying roller, and an agitator rotatably installed on the hopper. A rotary shaft of the agitator is disposed in a position higher than an upper portion of the guide member.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
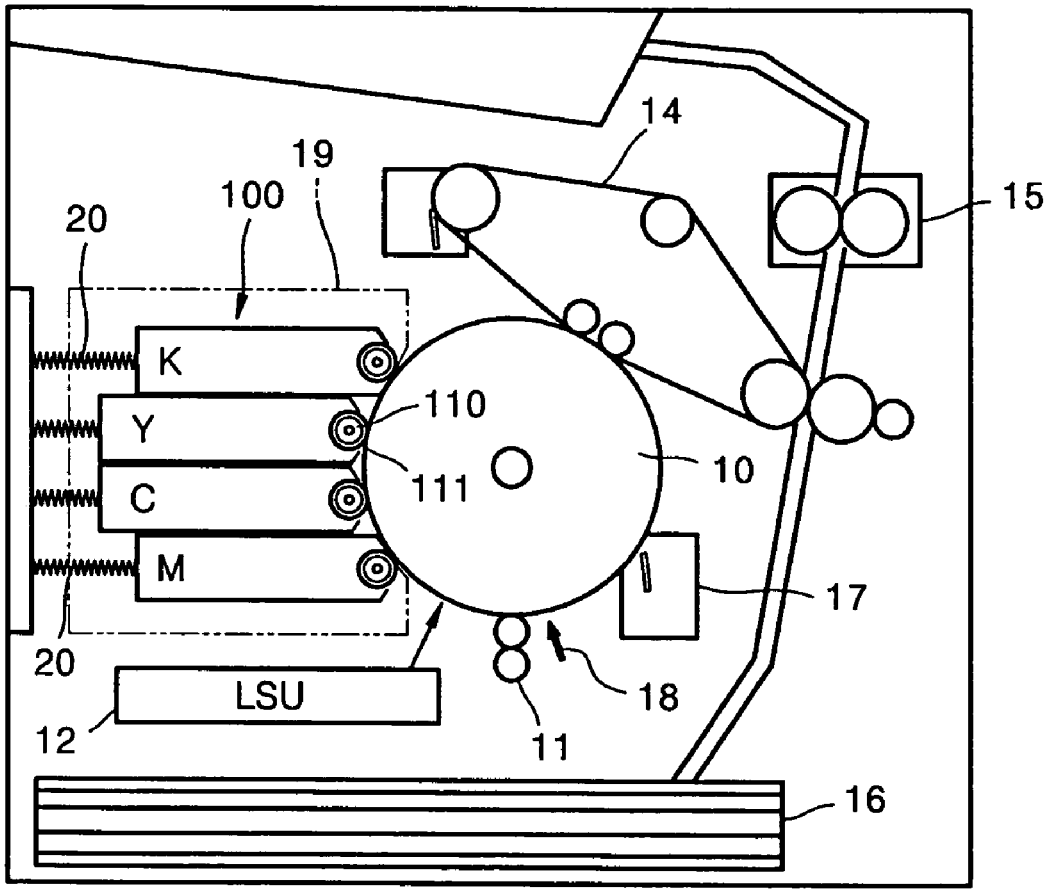
FIG. 1 is a schematic block diagram illustrating an electrophotographic image forming apparatus adopting a toner cartridge according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a view illustrating an electrophotographic image forming apparatus adopting a toner cartridge according to an embodiment of the present general inventive concept.

Referring to FIG. 1, the image forming apparatus may include a photosensitive drum 10, a charger 11 that charges the photosensitive drum 10, a laser scanning unit (LSU) 12 that is an exposure unit to form an electrostatic latent image by scanning light onto the charged photosensitive drum 10, a developing unit 19 having toner cartridges 100 (100M, 100C, 100Y, and 100K) that are the developers to develop the electrostatic latent image with powder tones of yellow (Y), magenta (M), cyan (C), and black (K) colors, a transfer unit including a transfer belt 14 that receives developed images of four colors developed on the photosensitive drum 10 and transfers the developed images on a sheet of paper to form a transfer image, and a recording unit 15 that records the transferred image on the paper by heating and pressing the paper. Reference numeral 16 denotes a paper cassette, reference numeral 17 denotes a photosensitive drum cleaning unit, and reference numeral 18 denotes an eraser.

Here, each of the toner cartridges 100 (100M, 100C, 100Y, and 100K) of the four colors may include a developing roller 110 that supplies the toner stored in the toner cartridge (100M, 100C, 100Y, or 100K) to an outer circumferential surface of the photosensitive drum 10 without contacting the photosensitive drum 10, and a gap maintaining roller 111 that is installed coaxially with the developing roller 110 and adheres to the photosensitive drum 10 to maintain a predetermined gap between the outer circumferential surface of the photosensitive drum 10 and the developing roller 110. In addition, each of the toner cartridges 100 (100M, 100C, 100Y, and 100K) is elastically biased toward the photosensitive drum 10 by a spring 20 so that the gap maintaining roller 111 adheres to the photosensitive drum 10.

The toner cartridges 100 (100M, 100C, 100Y, and 100K) having the above structure can be stacked in a horizontal direction and can be used in a compact color printer.

Figure 2:
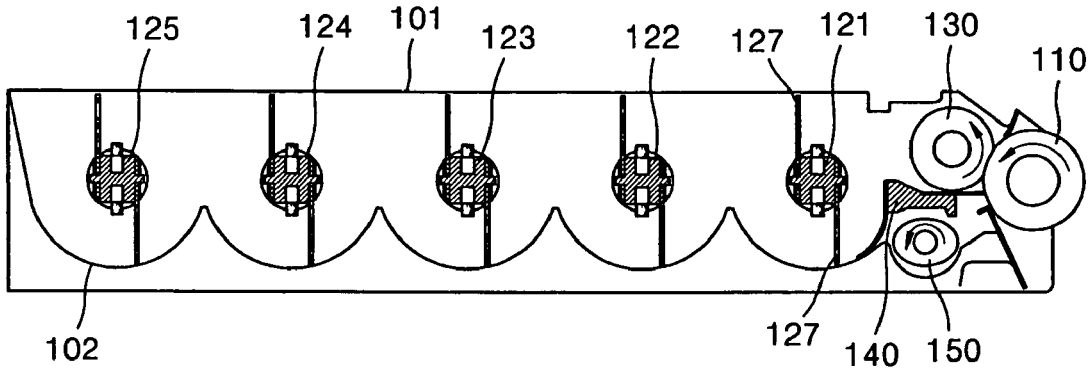
FIG. 2 is a cross-sectional view illustrating a toner cartridge according to another embodiment of the present general inventive concept.
Figure 3:
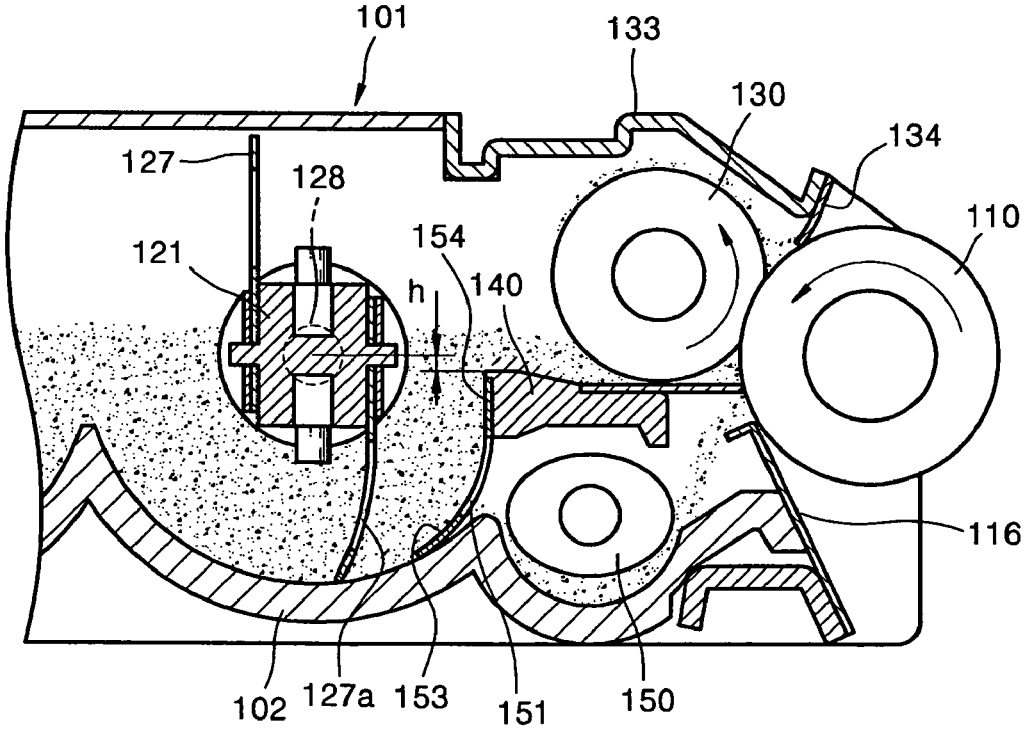
FIG. 3 is a partially enlarged view illustrating a portion of the toner cartridge of FIG. 2.

FIG. 2 is a cross-sectional view illustrating a toner cartridge according to another embodiment of the present invention, and FIG. 3 is an enlarged view of a portion of the toner cartridge of FIG. 2.

Referring to FIGS. 2 and 3, five semicircular hoppers 102 can be sequentially formed at a lower portion of a housing 101 of each toner cartridge 100 (100M, 100C, 100Y, or 100K), and each of the hoppers 102 can include an agitator 121, 122, 123, 124, or 125. The developing roller 110 is installed on a front end portion of the housing 101, and a toner supplying roller 130 contacts the developing roller 110. A guide member 140 that receives the toner supplied from the agitator (first agitator) 121 and guides the toner to be attached onto an outer circumference of the toner supplying roller 130 can be disposed under the toner supplying roller 130. A recovery roller 150 that recovers remaining toner, which is not supplied to the developing roller 110 from the toner supplying roller 130, toward a first hopper 102 on which the agitator 121 is disposed, is installed under the guide member 140.

The toner supplying roller 130 can rotate in the same direction as that of the developing roller 110 to clean the remaining toner on the surface of developing roller 110 by contacting the developing roller 110. In addition, the toner supplying roller 130 can supply the toner to the developing roller 110 by pressing the toner on the surface of the cleaned developing roller 110 immediately before contacting the developing roller 110.

A doctor blade 116 that controls the toner on the surface of the developing roller 110 can be installed at the housing 101 to remove an excessive toner from the developing roller 110.

A member 153 to block an opening portion between the guide member 140 and the first hopper 102 can be installed therebetween, and the member 153 can include a plurality of recovery holes 151. The toner removed from the developing roller 110 by the doctor blade 116 and the toner passing through a toner supplying path without being attached onto the developing roller 110 can be returned to the first hopper 102 by the recovery roller 150 through the recovery holes 151.

A seal bracket 133 that covers the developing roller 110 and the toner supplying roller 130 and prevents the toner from leaking can be installed on an upper portion of the housing 101. A seal film 134 can be installed at the seal bracket 133 to contact the surface of the developing roller 110 and to prevent the toner between the developing roller 110 and the toner supplying roller 130 from leaking out, and also to prevent external impurities from penetrating into the toner cartridge.

Figure 4:
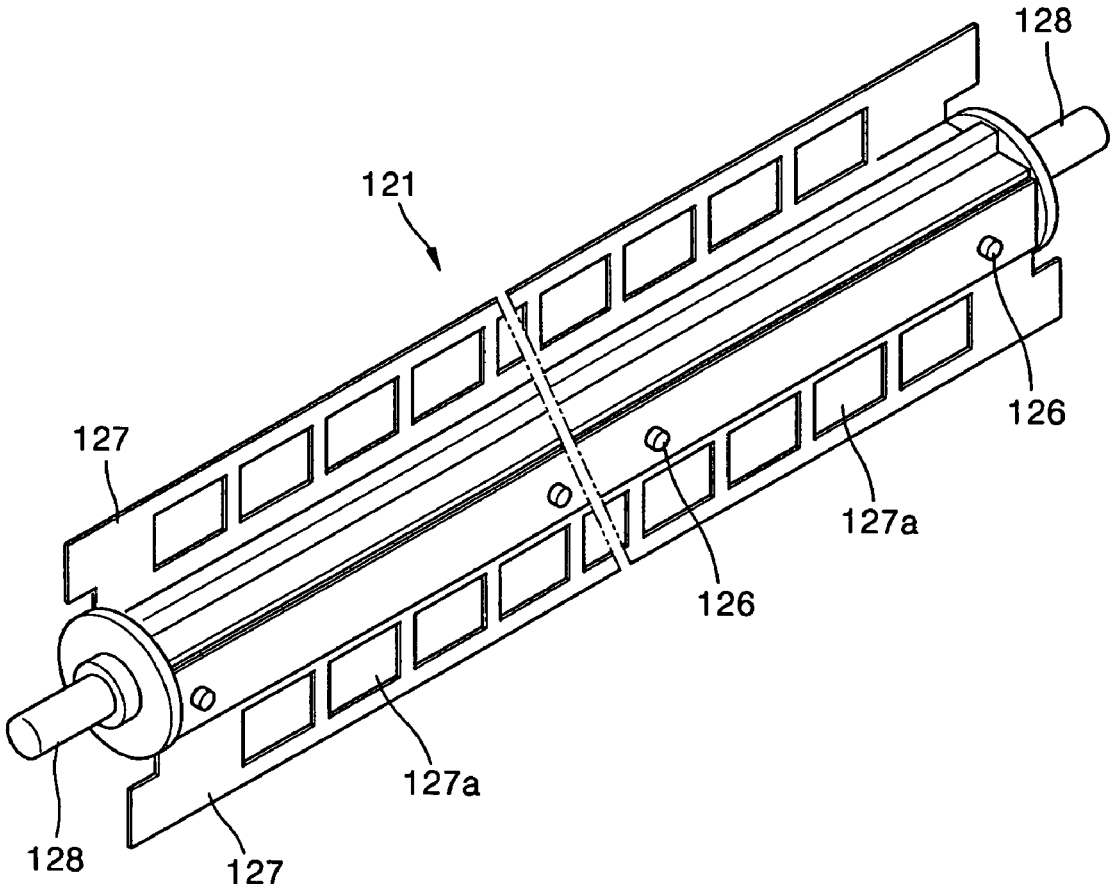
FIG. 4 is a perspective view illustrating a agitator used with a toner cartridge according to another embodiment of the present general inventive concept.

FIG. 4 is a perspective view illustrating an agitator (first agitator) 121 used with a toner cartridge according to an embodiment of the present general inventive concept.

Referring to FIGS. 2 through 5, the agitators 121 through 125 are similar to each other, thus only the agitator 121 will be described. The agitator 121 can mix the toner collected by the recovery roller 150 and the toner in the hopper 102 while supplying the toner between the guide member 140 and the toner supplying roller 130. The agitator 121 can include a plurality of protrusions 126 formed on a pair of surfaces disposed opposite to each other with respect to a rotation center thereof, and the protrusions 126 can be inserted into holes (not shown) formed on an elastic film 127 so that a pair of elastic films 127 can be point symmetric with each other. The elastic film 127 can be fabricated using a polyethylene-terephthalate (PET) film, for example. A plurality of square holes 127*a* can be formed on the elastic film 127. The square holes 127*a* can allow the agitator 121 to supply the toner to the toner supplying roller 130 and to mix the toner in the hopper 102. Reference numeral 128 denotes rotating protrusions formed on both sides of the agitator 121 to form a coaxis with the agitator 121.

Figure 5:
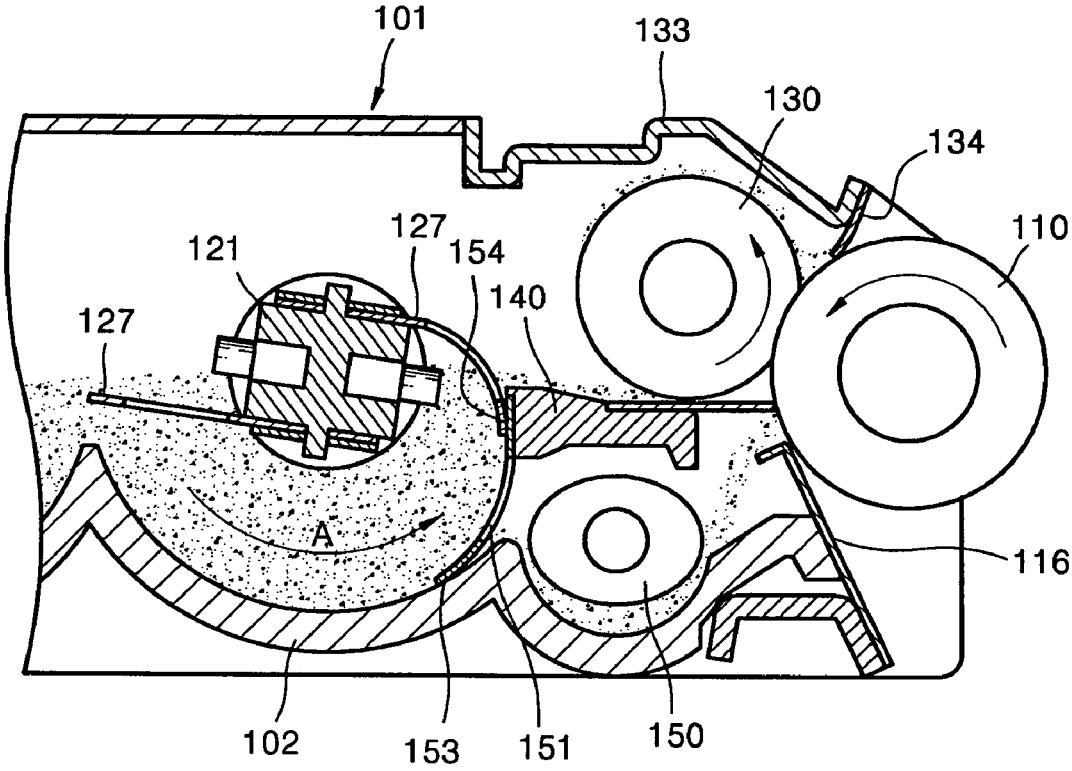
FIG. 5 is a view illustrating an operation of the agitator of FIG. 4.

The elastic film 127 can contact an inner surface of the hopper 102 and a guide surface 154 of the guide member 140 when it rotates. A rotating protrusion 128, that is, a rotary shaft of the agitator 121, can be located higher than an upper portion of the guide member 140 by a distance (height) 'h' in FIG. 3, thus an end of the film 127 can contact the inner surface of the hopper 102 as bent when the agitator 121 rotates (referring to FIG. 3). FIG. 5 is a view illustrating an operation of the agitator 121 of FIG. 4. As shown in FIG. 5, when the elastic film 127 contacts the guide surface 154, the elastic film 127 can be inclined upward, and an end portion of the elastic film 122 is elastically biased to a downward direction. Then, when the agitator 121 further rotates in a direction of an arrow A, the elastic film 127 can escape the guide surface 154 and can be recovered to an original shape of the elastic film 127 to supply the toner between the guide member 140 and the toner supplying roller 130.

As described above, according to the toner cartridge of the present general inventive concept, since the rotary shaft of the agitator is disposed in a position higher than that of the upper portion of the guide member, a flow of toner toward the toner supplying roller can be performed smoothly. A stable supply of the toner improves a printing quality of the image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner cartridge used with electrophotographic image forming apparatus having a photosensitive drum, the toner cartridge comprising:

a developing roller to develop an electrostatic latent image formed on an outer circumferential surface of a photosensitive drum;

a toner supplying roller to supply toner onto the developing roller;

a guide member installed under the toner supplying roller to guide the toner to be attached onto a surface of the toner supplying roller by a predetermined thickness;

a hopper to store the toner to be supplied to the toner supplying roller through the guide member; and an agitator rotatably installed in the hopper, wherein the agitator comprises a rotary shaft disposed in a position higher than an upper portion of the guide member, and the guide member comprises a guide surface to face the agitator.

2. The toner cartridge of claim 1, wherein the agitator comprises a pair of elastic films installed on a pair of parallel surfaces of the agitator, which are point symmetric with each other.

3. The toner cartridge of claim 2, wherein the elastic film is installed to contact an inner surface of the hopper and the guide surface of the guide member.

4. The toner cartridge of claim 3, wherein the elastic film is recovered into its original shape when the elastic film escapes the inner surface of the hopper and the guide surface to supply the toner between the toner supplying roller and the guide member.

5. The toner cartridge of claim 2, wherein the agitator further comprises:

a plurality of protrusions formed on corresponding ones of the pair of parallel surfaces of the agitator, and the protrusions are inserted into the pair of elastic films so that the agitator and the pair of elastic films are fixedly coupled.

6. The toner cartridge of claim 1, wherein the hopper comprises a plurality of successive sub-hoppers, and the agitator is installed in each hopper.

* * * * *